US006356642B1

(12) United States Patent
Nakamura et al.

(10) Patent No.: US 6,356,642 B1
(45) **Date of Patent: *Mar. 12, 2002**

(54) MULTI-SPEAKER SYSTEM

(75) Inventors: Takeshi Nakamura, Uji; Yoshiaki Heinouchi, Jouyou; Takao Mori, Kyoko, all of (JP)

(73) Assignee: Murata Manufacturing Co., Ltd

( * ) Notice: Subject to any disclaimer, the term of this patent is extended or adjusted under 35 U.S.C. 154(b) by 0 days.

This patent is subject to a terminal disclaimer.

(21) Appl. No.: 09/065,865

(22) Filed: Apr. 24, 1998

Related U.S. Application Data

(63) Continuation-in-part of application No. 08/760,639, filed on Dec. 4, 1996, now Pat. No. 5,802,196, and a continuation-in-part of application No. 08/864,334, filed on May 28, 1997, now Pat. No. 5,896,460.

(30) Foreign Application Priority Data

Dec. 27, 1997 (JP) ..... 9-368134

(51) Int. Cl.[7] ..... H04R 25/00

(52) U.S. Cl. ..... 381/342; 381/190; 381/340; 181/144

(58) Field of Search ..... 381/341, 182, 381/186, 99, 89, 87, 190, 332, 386, 351, 342, 173, 114; 181/144, 145, 147

(56) References Cited

U.S. PATENT DOCUMENTS

| | | | | |
|---|---|---|---|---|
| 3,816,672 A | * | 6/1974 | Gefvert et al. | 381/432 |
| 4,268,719 A | * | 5/1981 | Manger | 381/89 |
| 4,348,549 A | * | 9/1982 | Berlant | 381/99 |
| 5,073,945 A | * | 12/1991 | Kageyama et al. | 381/89 |
| 5,802,196 A | * | 9/1998 | Nakamura | 381/202 |
| 5,896,460 A | * | 4/1999 | Nakamura et al. | 381/190 |

* cited by examiner

*Primary Examiner*—Curtis Kuntz
*Assistant Examiner*—Suhan Ni
(74) *Attorney, Agent, or Firm*—Keating & Bennett, LLP

(57) ABSTRACT

A multi-speaker apparatus generates and transmits sound waves in all directions toward and away from a surface upon which the apparatus is installed or mounted. The multi-speaker apparatus includes a middle/high frequency sound range speaker and a low frequency sound range speaker. The middle/high frequency sound range speaker and the low frequency sound range speaker are arranged relative to each other such that center axes thereof are aligned with an axis that is substantially perpendicular the surface upon which the apparatus is installed or mounted. A horn and a cabinet are arranged such that sound waves generated from the middle/high frequency sound range speaker and the low frequency sound range speaker are emitted in all directions both toward and away from the surface upon which the apparatus is supported or mounted.

20 Claims, 5 Drawing Sheets

MULTI-SPEAKER SYSTEM

This Application is a Continuation-In-Part of U.S. patent application Ser. No. 08/760,639 filed Dec. 4, 1996, now U.S. Pat. No. 5,802,196 and U.S. patent Ser. No. 08/864,334 filed May 28, 1997, now U.S. Pat. No. 5,896,460, both currently pending.

BACKGROUND OF THE INVENTION

1. Field of the Invention

The present invention relates to a multi-speaker apparatus and more particularly, to a multi-speaker apparatus including a plurality of speakers having different sound frequency ranges defining a 2-way or 3-way speaker apparatus including a woofer, a mid-range speaker and a tweeter, for example.

2. Description of the Related Art

In related prior art multi-speaker devices, a vibrating body such as a cone of each speaker and an opening provided in a cabinet for each speaker are provided at a front side thereof so as to face listeners.

One prior art multi-speaker device is arranged such that each speaker of the multi-speaker device has a driving section such as a voice coil which is parallel to the front side of the speaker cabinet in order to align the driving section of each speaker with one surface thereof to phase sounds generated from each of the speakers.

Another prior art multi-speaker device has a mid-range frequency speaker and tweeter disposed aligned along a central axis of a woofer and a center axis of each of the mid-range frequency speaker, tweeter and woofer speakers of the multi-speaker device is parallel to the surface on which the device is installed or supported in order to unify the direction of sound waves generated and transmitted from each of the speakers.

However, because all of the above-mentioned prior art multi-speaker devices have a sound directionality in a direction parallel to the surface on which the apparatus is installed or supported caused by the above-described parallel axis relationship, a frequency range where the best stereo sound is obtained has been very narrow and located at an intersection of center axes or sound axes of two of the multi-speaker devices which are spaced apart and define right and left multi-speaker devices and are angled relative to each other such that sound openings for the respective speakers contained therein direct sound waves to provide an intersection of the right and left multi-speaker devices. This directionality and intersection of right and left multi-speaker devices produces lower volume and lower quality sound.

SUMMARY OF THE INVENTION

To overcome the problems described above, the preferred embodiments of the present invention provide a multi-speaker apparatus which is adapted and constructed to be non-directional relative to a surface on which the apparatus is installed or supported.

According to one preferred embodiment of the present invention, a multi-speaker apparatus includes a plurality of speakers which have different sound frequency ranges. The plurality of speakers are arranged such that center axes of the speakers are aligned along an axis which extends in a direction substantially perpendicular to a surface on which the apparatus is installed or supported. As a result, sound waves generated from the plurality of speakers of the multi-speaker apparatus are emitted in an entire azimuth or 360 degree range relative to the surface on which the apparatus is installed or supported.

According to another preferred embodiment of the present invention, one of the plurality of speakers of the multi-speaker apparatus includes is a low frequency range speaker unit provided within a cabinet. The cabinet preferably includes a bottom plate arranged substantially parallel to a surface upon which the multi-speaker apparatus is installed or supported while defining a space between the surface on which the multi-speaker apparatus is installed or supported and an upper plate of the cabinet which is arranged to be substantially parallel to the bottom plate. A bass reflex port is preferably provided at a substantially central portion of the upper plate and the low frequency sound range speaker unit is mounted so as to surround an opening in the cabinet so that a vibrating body of the low frequency sound range speaker unit faces the surface on which the multi-speaker apparatus is installed or supported via the opening in the cabinet. As a result of this arrangement, sound waves emanating from the vibrating body of the low frequency sound range speaker unit are at least partially transmitted in all directions or a 360 range toward the surface on which the multi-speaker apparatus is mounted or supported. Other sound waves emanating from the vibrating body of the low frequency sound range speaker are transmitted via the bass reflex port in all directions or a 360 degree range away from the surface on which the multi-speaker apparatus is mounted or supported.

Furthermore, another speaker in the inventive multi-speaker apparatus comprises a middle to high frequency sound range speaker which is mounted on the low frequency sound range speaker. The middle/high frequency sound range speaker including a substantially semi-spherical vibrating body, a driving device for vibrating the vibrating body, and a horn having a sound path which is folded and extends from a curved inner surface of the vibrating body toward an outside of the middle/high frequency sound range speaker. A cavity which communicates with the sound path is defined between the vibrating body and the horn and openings of the sound path are arranged such that sound waves are transmitted from the openings in all directions or a 360 degree range toward the surface on which the multi-speaker apparatus is supported or installed and sound waves emanating from the substantially semi-spherical vibrating body are transmitted in all directions or in a 360 degree range away from the surface on which the multi-speaker apparatus is supported or installed.

In the preferred embodiments of the present invention, the center axes of the plurality of speakers of the multi-speaker apparatus are preferably aligned relative to an axis which extends in a direction that is substantially perpendicular to a surface on which the multi-speaker apparatus is installed or supported and sound waves generated from the plurality of speakers of the multi-speaker apparatus are emitted in all directions or a 360 degree range both toward and away from a surface on which the multi-speaker apparatus is installed or supported, so that the sound generated from each speaker is emitted in waves which are substantially centered relative to the axis which extends in the direction that is substantially perpendicular to the surface on which the multi-speaker apparatus is installed or supported.

Accordingly, the multi-speaker apparatus according to preferred embodiments of the present invention is non-directional relative to a surface on which the multi-speaker apparatus is installed and achieves significantly increased sound volume and quality achieved by the omni-directional sound emanation of each of the speakers contained in the multi-speaker apparatus.

These and other elements, features, and advantages of the present invention will be apparent from the following detailed description of preferred embodiments of the present invention, illustrated in the accompanying drawings.

DETAILED DESCRIPTION OF PREFERRED EMBODIMENTS

Figure 1:
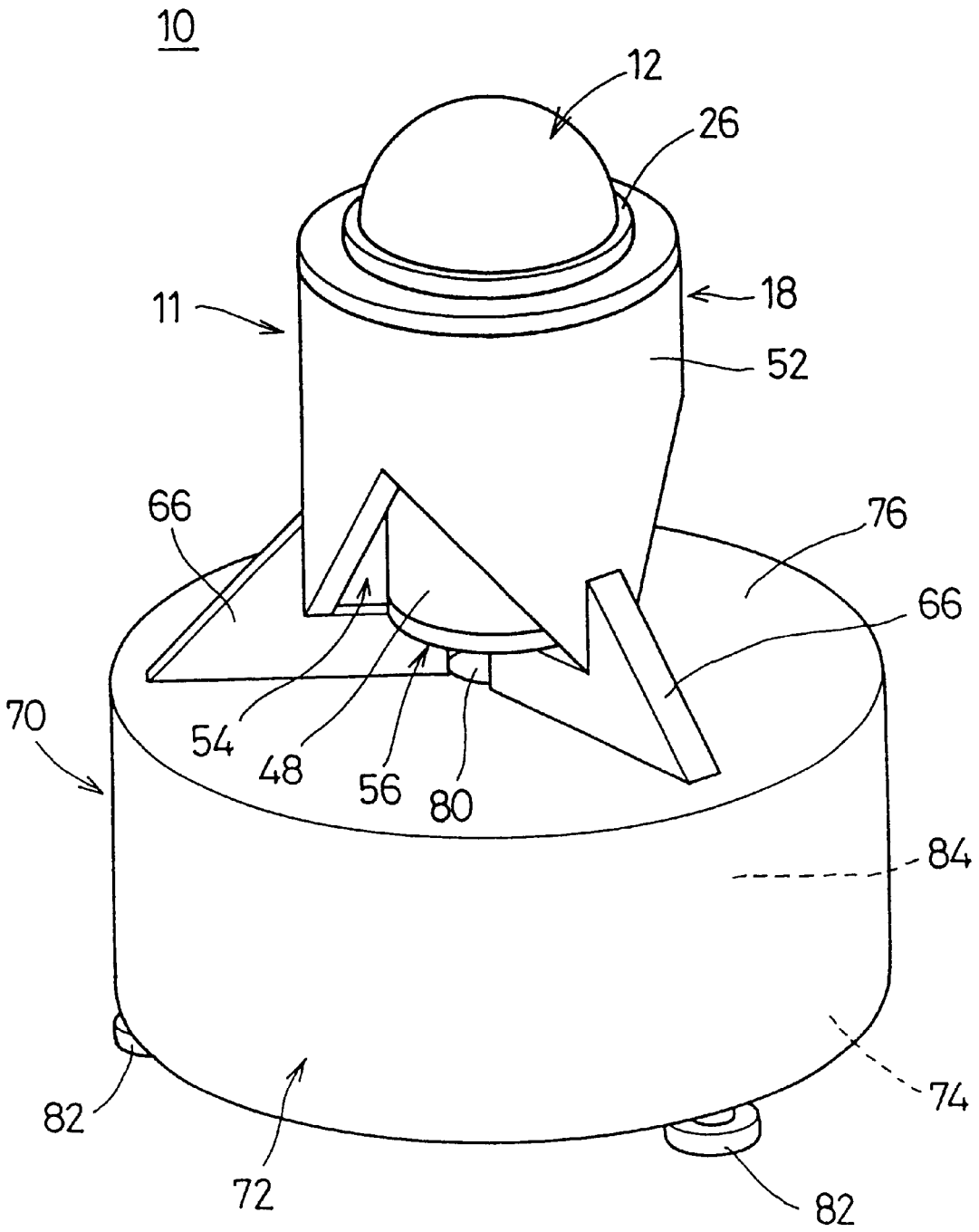
FIG. 1 is a perspective view showing one example of a preferred embodiment of a multi-speaker apparatus according to the present invention.
Figure 2:
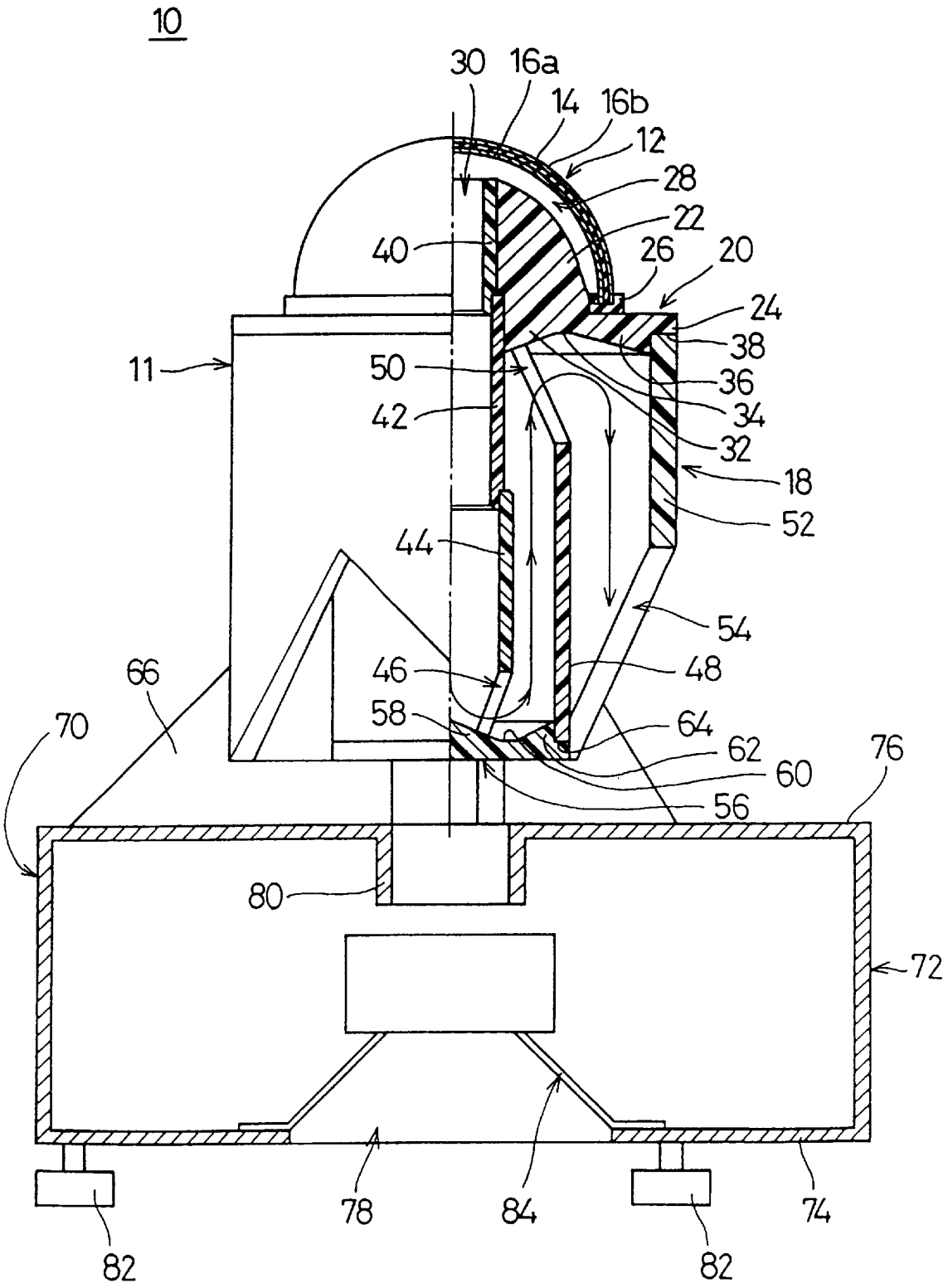
FIG. 2 is a partially sectional diagrammatic view of the multi-speaker apparatus shown in FIG. 1.
Figure 3:
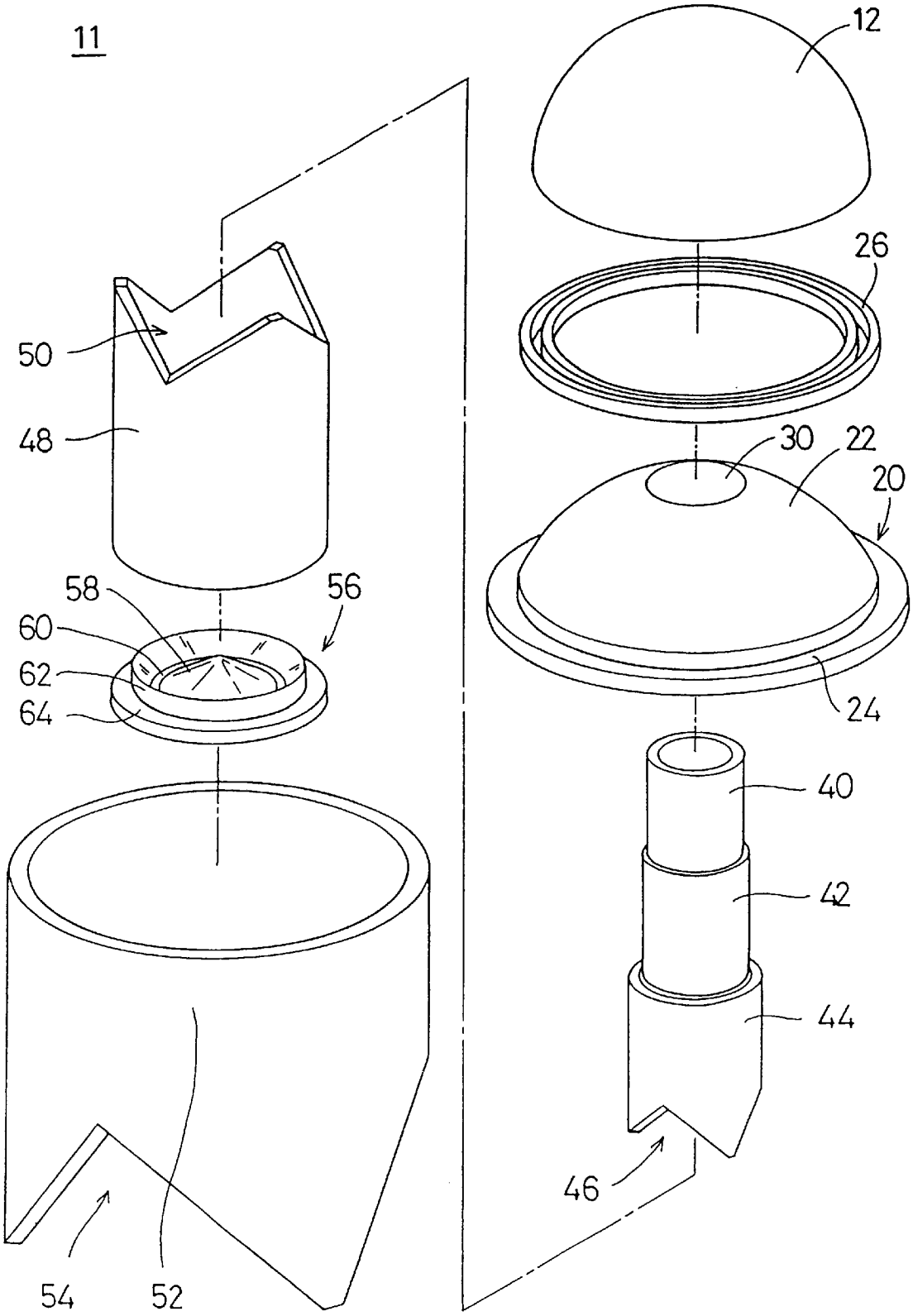
FIG. 3 is a perspective exploded view showing a middle/high frequency sound range speaker used in the multi-speaker apparatus shown in FIG. 1.

FIG. 1 is a perspective view showing one example of a preferred embodiment of a multi-speaker apparatus of the present invention, FIG. 2 is a partially sectional diagrammatic view thereof and FIG. 3 is a perspective exploded view showing a middle/high frequency sound range speaker used therein.

A multi-speaker apparatus 10 shown in FIGS. 1 and 2 includes a middle/high frequency sound range speaker 11, for example. The middle/high frequency sound range speaker 11 includes a substantially semi-spherical vibrator 12.

The vibrator 12 includes a semi-spherical vibrating body 14 preferably made of a piezoelectric body such as a ceramic. Driving electrodes 16*a* and 16*b* are provided on curved inner and outer surfaces of the vibrating body 14 for vibrating the vibrating body 14. The vibrating body 14 is preferably polarized in a direction of thickness thereof, e.g. from an outer surface to the inner surface.

The vibrator 12 is secured to a horn 18 which is preferably made of synthetic resin, for example. The horn 18 comprises an upper base 20. The upper base 20 has a projecting portion 22 having a shape that substantially corresponds to a shape of the vibrator 12 and flange portion 24 disposed around the projecting portion 22. The vibrator 12 is arranged so as to cover the projecting portion 22 and is bonded on the flange portion 24 surrounding the projection portion 22 via a supporting member 26 preferably made of a ringed insulator having a groove. A cavity 28 for allowing the vibrator 12 to vibrate freely and unimpeded is provided between the vibrator 12 and the projecting portion 22. The driving electrodes 16*a* and 16*b* of the vibrator 12 are connected to input terminals (not shown) provided on the outside of the vibrator 12 via conductors such as a conductive ribbon connected to the inner electrode 16*a* and which is interposed between the upper base 20 and the supporting member 26 and a conductive ribbon connected to the outer electrode 16*b* at the outside thereof.

A hole 30 preferably having a substantially circular section is created preferably at the approximate center of the upper base 20 so as to communicate with the cavity 28. The hole 30 preferably has stepped portions so that the portion of the hole 30 located near the cavity 28 is the narrowest of the stepped portions. On the lower surface of the upper base 20, a ringed convex portion 32 having a triangular section is created so as to surround the hole 30, a ringed flat portion 34 is created so as to surround the convex portion 32, a ringed convex portion 36 having a triangular section is created so as to surround the flat portion 34 and a ringed flat portion 38 is created on the outermost portion so as to surround the convex portion 36.

A first cylinder 40 and a second cylinder 42 having a diameter larger than that of the first cylinder 40 are secured to the hole 30 of the upper base 20. An inner surface of one end of the second cylinder 42 is connected to a stepped portion on the outer surface of one end of the first cylinder 40 so as to define a stepped portion of the hole 30. The outer surface of the first cylinder 40 and the outer surface of the one end of the second cylinder 42 are connected to the inner surface of the upper base 20 so as to define a portion of the hole 30. Further, an inner surface of one end of a third cylinder 44 having a diameter that is larger than that of the second cylinder 42 is connected to a stepped portion on the outside of the other end of the second cylinder 42 to form a stepped portion of the hole 30. A plurality, preferably three, of substantially V-shaped notches 46 are made preferably at equal intervals from each other and extend around almost an entire circumference of the other end of the third cylinder 44. Each notch 46 is arranged so as to gradually expand as it gets closer to the end surface of the other end or bottom of the third cylinder 44.

A fourth cylinder 48 having a diameter which is larger than that of the third cylinder 44 is secured to the flat portion 34 of the upper base 20. That is, the fourth cylinder 48 is disposed around the second cylinder 42 and the third cylinder 44 so that one end thereof extends downwardly. Three substantially V-shaped notches 50 are preferably provided at substantially equal intervals from each other and extend almost around the entire circumference of the other end of the fourth cylinder 48. Each notch 50 is preferably made so as to expand gradually as it gets closer to the end surface of the other end of the fourth cylinder 48. The end surface of the other end of the fourth cylinder 48 is connected to the flat portion 34 of the upper base 20. The three notches 50 of the fourth cylinder 48 are preferably disposed at circumferential positions corresponding to circumferential locations of the three notches 46 of the third cylinder 44 when viewed in plane. It is noted that the notches 50 of the fourth cylinder 48 may be disposed in a zigzag arrangement or at positions not corresponding to those of the notches 46 of the third cylinder 44 and may be staggered or disposed alternately with respect to the notches 46, for example.

Further, a fifth cylinder 52 having a diameter which is larger than that of the fourth cylinder 48 is connected to the flat portion 38 of the upper base 20. That is, the fifth cylinder 52 is disposed to surround the fourth cylinder 48 so that one end of the fourth cylinder 48 having the apertures 50 faces upwardly. Three substantially V-shaped notches 54 which define openings of a sound path of the speaker 11 are preferably created at substantially equal intervals from each other and extend almost around the whole circumference of the other end of the fifth cylinder 52. Each notch 54 is created so as to expand gradually as it gets closer to the end surface of the other end of the fifth cylinder 52. The end surface of the other end of the fifth cylinder 52 is connected to the flat portion 38 of the upper base 20. The three notches 54 of the fifth cylinder 52 are preferably disposed at positions corresponding to circumferential locations of the three notches 50 of the fourth cylinder 48 when seen in plane. The notches 54 of the fifth cylinder 52 may be disposed at positions not corresponding to those of the notches 50 of the fourth cylinder 48 when seen in plane and may be staggered or disposed alternately with respect to the notches 50, for example.

Further, the end surface of the other end of the third cylinder 44 and the end surface of one end of the fourth cylinder 48 are secured to a disk like lower base 56. That is, a substantially conical convex portion 58 is created on the upper surface of the lower base 56 at an approximate center thereof, a ringed flat portion 60 is created so as to surround the convex portion 58, a ringed convex portion 62 having a substantially triangular section is created so as to surround the flat portion 60, and a ringed flat portion 64 is created at an outer-most position so as to surround the convex portion 62. The end surface of the other end of the third cylinder 44 and the end surface of the one end of the fourth cylinder 48 are connected to the flat portions 60 and 64 of the lower base 56, respectively.

In the horn 18, a sectional area thereof expands in a stepwise manner in order of the inner part of the first cylinder 40 which communicates with the cavity 28, the inner part of the second cylinder 42, the inner part of the third cylinder 44, the notches 46 of the third cylinder 44, the part created between the third cylinder 44 and the fourth cylinder 48, the part created between the second cylinder 42 and the fourth cylinder 48, the notches 50 of the fourth cylinder 48, the part created between the fourth cylinder 48 and the fifth cylinder 52 and the notches 54 of the fifth cylinder 52. A long sound path is thus created by this arrangement. The sectional area S of each part which composes the sound path of the horn 18 is set so as to have a relationship $S=S_T\,\epsilon^{mL}$, where $S_T$ is a sectional area at a throat portion (the narrowest part where the sound path begins), L is a distance from the throat portion to the center part of each portion composing the sound path and m is a coefficient defined by a cut-off frequency of the horn 18. Accordingly, the sectional area of the sound path changes substantially logarithmically, though stepwise, with respect to the length of the sound path in the horn 18 similarly to an exponential horn.

The cavity 28 and the sound path are created so that sound emitted from the curved outer surface of the vibrator 12 and the sound waves emanating from the curved inner surface of the vibrator 12 via the cavity 28 and the sound path have almost the same phase relative to a plane of speaker support so that those sound waves do not cancel each other out or interfere with each other.

A plurality of plate-like leg members 66 act as a spacer and are preferably made of synthetic resin, for example. The leg members 66 are preferably secured at substantially equal intervals from each other at the bottom of the fifth cylinder 52 and the lower base 56 of the middle/high frequency sound range speaker 11.

This middle/high frequency sound range speaker 11 is preferably mounted on a low frequency sound range speaker 70. The middle/high frequency sound range speaker 11 and the low frequency sound range speaker 70 are arranged so that a center axis of the middle/high frequency sound range speaker 11 and a center axis of the low frequency sound range speaker 70 are substantially aligned with an axis which extends in a direction that is substantially perpendicular relative to the surface upon which the multi-speaker apparatus 10 is mounted or installed.

The low frequency sound range speaker 70 includes a hollow columnar cabinet 72 made of synthetic resin, for example. The cabinet 72 has a disk-like bottom plate 74 and an upper plate 76 which are arranged to be substantially parallel to each other. The middle/high frequency sound range speaker 11 described above is placed on the upper plate 76 of the cabinet 72.

A circular opening 78, for example, is preferably created at an approximate center of the bottom plate 74 of the cabinet 72. Further, a cylindrical bass reflex port 80 is preferably provided at the approximate center of the upper plate 76 of the cabinet 72. A plurality of leg members 82 which act as spacers are provided at substantially equal intervals from each other under the bottom plate 74 of the cabinet 72 such that the bottom plate 74 is substantially parallel to the surface upon which the multi-speaker apparatus 10 is mounted or installed while defining a space between the mounting or installation surface and the bottom plate 74.

A low frequency sound range speaker unit 84 is provided within the cabinet 72. The low frequency sound range speaker unit 84 is mounted around the opening 78 at the approximate center of the bottom plate 74 of the cabinet 72 so that a vibrating body such as a cone of the low frequency sound range speaker unit 84 is directed, via the opening 72 of the cabinet, toward and faces the surface on which the apparatus 10 is mounted or installed. The low frequency sound range speaker unit 84 is connected to the input terminal (not shown) which is connected to the electrodes 16*a* and 16*b* of the vibrator 12 of the middle/high frequency sound range speaker 11 described above preferably via a lead wire (not shown) which penetrates through the cabinet 72.

In the multi-speaker apparatus 10, when electrical signals are input to the input terminal, the vibrator 12 of the middle/high frequency sound range speaker 11 vibrates, emitting sound from the curved outer surface of the vibrator 12 as well as from the curved inner surface of the vibrator 12 via the cavity 28 and the sound path. Further, the low frequency sound range speaker unit 84 of the low frequency sound range speaker 70 is driven, emitting sound from the opening 78 of the cabinet 72 as well as from the bass reflex port 80 of the cabinet 72.

Because the vibrator 12 and the vibrating body 14 have a substantially semi-spherical shape, the sound waves emitted from the curved outer surface of the vibrator 12 of the middle/high frequency sound range speaker 11 is radiated away from the speaker support surface in all directions relative to the plane of speaker support or installation. Further, because the notches 54, the openings of the sound path, are disposed along almost the entire circumference of the speaker, the sound waves radiated from the curved inner surface of the vibrator via the cavity 28 and the sound path are radiated toward the speaker support surface in all directions relative to the speaker support surface. Thus, the sound waves emitted from the speaker 11 are non-directional both toward and away from the speaker support surface.

Further, because the bottom surface 74 of the cabinet 72 is arranged to be spaced from the speaker support surface, sound waves emitted from the opening 78 in the cabinet 72 of the low frequency sound range speaker 70 are radiated toward the speaker support surface in all directions relative to the speaker support surface. Further, the sound waves emitted from the low frequency sound range speaker 70 via the bass reflex port 80 of the cabinet 72 are emitted from the space between the upper surface 76 of the low frequency sound range speaker 70 and the fifth cylinder 52 and the lower base 56 of the middle/high frequency sound range speaker 11 are radiated away the speaker support surface in all directions relative to the speaker support surface. Thus, the sound waves emitted from the low frequency sound range speaker 70 are non-directional both toward and away from the speaker support surface.

Because the center axes of the middle/high frequency sound range speaker 11 and the low frequency sound range speaker 70, which have different frequency ranges, are substantially aligned with an axis which extends substantially perpendicular to a surface on which the multi-speaker apparatus 10 is mounted or installed, sound waves generated by the middle/high frequency sound range speaker 11 and the low frequency sound range speaker 70 are emitted in all directions or a 360 degree range both toward and away from the surface on which the apparatus is mounted or installed. Also, the sound waves generated by the middle/high frequency sound range speaker 11 and the low frequency sound range speaker 70 are emitted in waves which are substantially centered relative to the axis which extends substantially perpendicular to the surface upon which the apparatus 10 is supported or installed. Therefore, the multi-speaker apparatus 10 emits sound waves both toward and away from the apparatus support surface non-directionally. Accordingly, a range for producing the best stereo sound is substantially increased as compared with the prior art and is exceptionally wide regardless of a distance from an arrangement of two of the multi-speaker apparatuses 10 defining right and left multi-speaker apparatuses.

Further, an initial phase difference between the sound waves emitted from the curved outer surface of the vibrator 12 and the sound waves emitted from the curved inner surface of the vibrator is 180 degrees. However, those sound waves are caused to have almost the same phase relative to the plane of speaker installation or mounting via the cavity 28 and the sound path which function and define a phase shifting device. Therefore, the phase shifting device prevents the sound waves emitted from the curved inner and outer surfaces of the vibrator 12 from canceling each other but instead superimposes these sound waves so as to produce combined sound waves having high sound pressure in all directions relative to the plane of speaker installation or mounting.

Further, because the long sound path having a sectional area which changes almost logarithmically, though stepwise, with respect to the length thereof is created in the horn 18 in the multi-speaker apparatus 10, it is efficient in the middle frequency sound range.

Moreover, because the sound path of the horn 18 is created by the plurality of cylinders which are arranged to have spaces therebetween, the multi-speaker apparatus 10 has a substantially reduced size despite having a long sound path of the horn 18 and the efficiency in the middle frequency sound range.

Furthermore, because the notches 46 and 50 which define the folded parts of the sound path of the horn 18 expand gradually as they approach the outer portion of the respective folded parts in the middle/high frequency sound range speaker 11, the flow of the sound is quicker at the portion where the distance of the sound path is longer, i.e., at the outer portion of the folded part of the sound path, and is slower at the portion where the distance of the sound path is short, i.e. at the inner portion of the folded part. As a result, the velocities of the sound waves become almost equal at the outer portion and the inner portion of the folded parts of the sound path and the flow of sound is hardly disturbed at the folded parts of the sound path. Thereby, the novel sound path structure allows nearly all plane waves to be obtained and sound having less distortion to be obtained. In the same manner, the flow of sound is hardly disturbed at the notches 54, i.e., at the openings of the sound path of the horn 18, generating the nearly plane wave and sound having less distortion.

The multi-speaker apparatus 10 may be easily fabricated because the first cylinder 40, the third cylinder 44, the fourth cylinder 48 and the fifth cylinder 52 may be readily positioned on the upper base 20 and the lower base 56.

Figure 4:
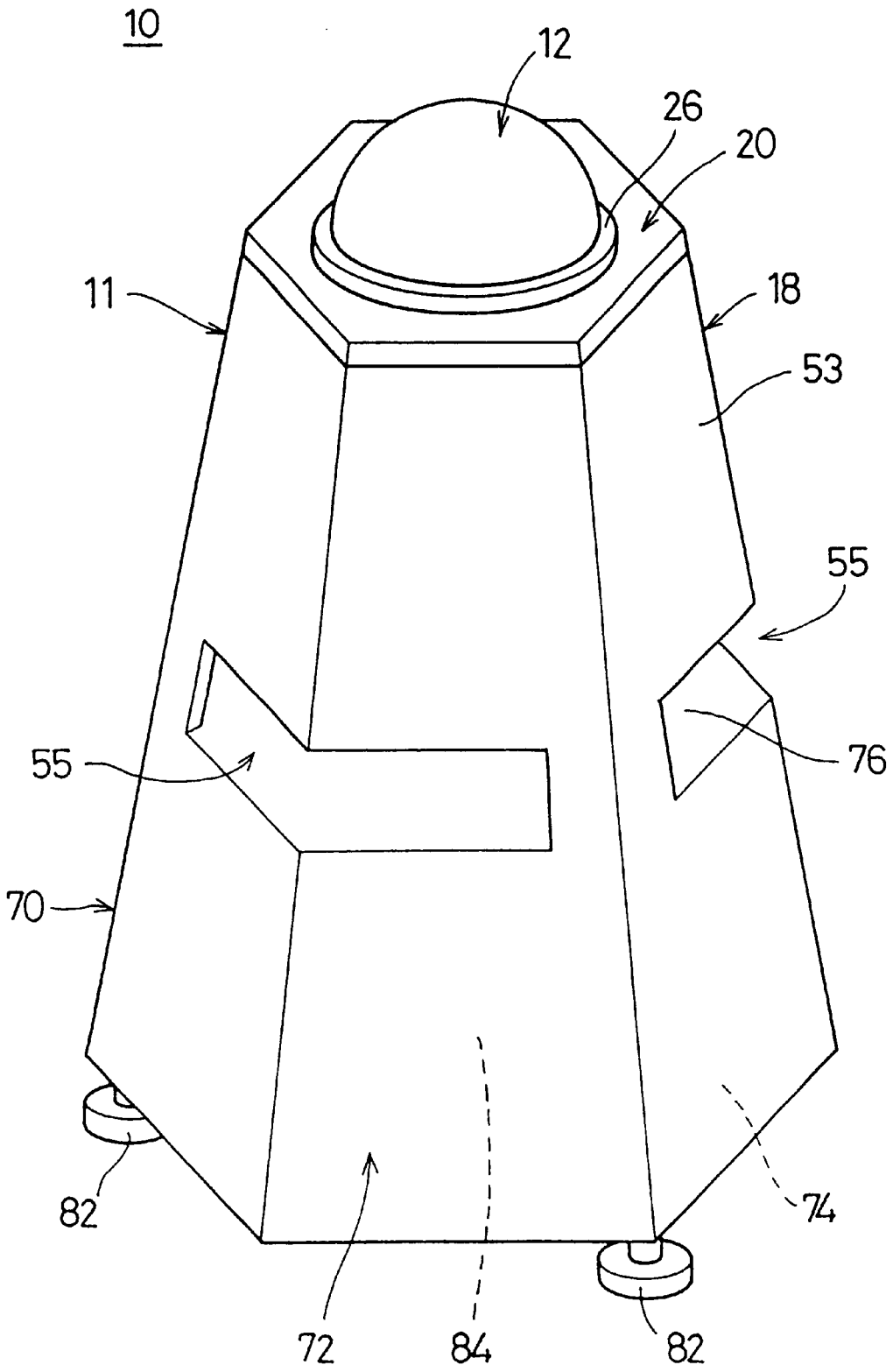
FIG. 4 is a perspective view showing another example of a multi-speaker apparatus of preferred embodiments of the present invention.
Figure 5:
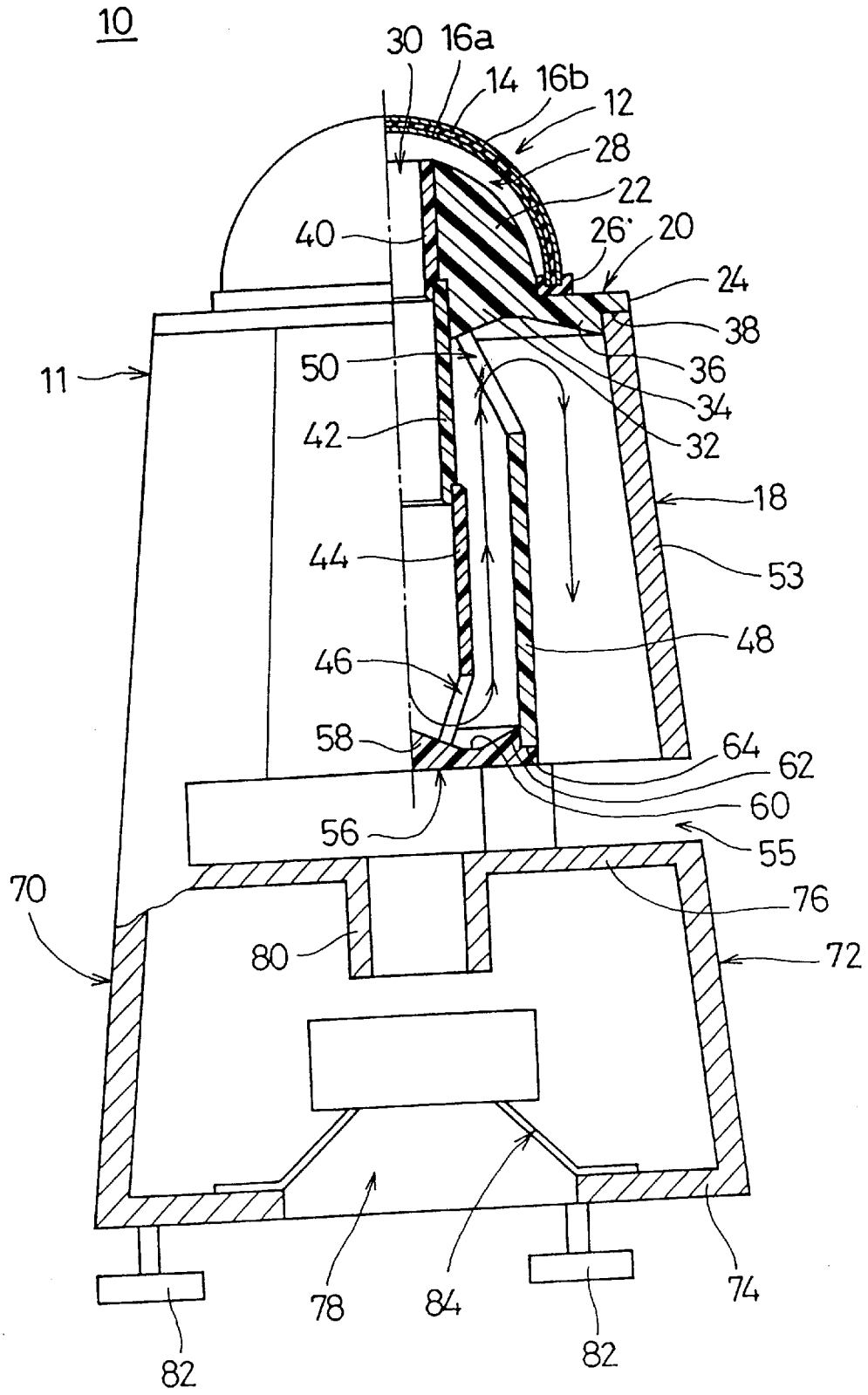
FIG. 5 is a partially sectional diagrammatic view of the multi-speaker apparatus shown in FIG. 4.

FIG. 4 is a perspective showing another preferred embodiment of a multi-speaker apparatus of the present invention and FIG. 5 is a partially sectional diagrammatic view thereof.

As compared to the multi-speaker apparatus 10 shown in FIGS. 1 and 2, the cabinet 72 of the low frequency sound range speaker 70 of the preferred embodiment shown in FIG. 4 preferably has a hollow hexagonal truncated pyramid shape. More particularly, the cabinet 72 shown in FIGS. 4 and 5 includes a side member 53 having the shape of the hollow hexagonal truncated pyramid and is preferably made of synthetic resin, for example. The side member 53 is provided instead of the fifth cylinder 52 shown in FIG. 3. The leg members 66 of the middle/high frequency sound range speaker 11, and the flange portion 24 of the upper base 20 preferably has a shape of a substantially hexagonal plate in the multi-speaker apparatus shown in FIGS. 4 and 5. Further, the upper part of the side member 53 is preferably connected to the flat portion 38 of the upper base 20 of the middle/high frequency sound range speaker 11 and the lower part thereof is connected to the cabinet 72 of the low frequency sound range speaker 70. The side member 53 is arranged such that a center axis of the middle/high frequency sound range speaker 11 and a center axis of the low frequency sound range speaker 70 are substantially aligned with each other and an axis which extends in a direction that is substantially perpendicular relative to a surface on which the multi-speaker apparatus 10 is mounted or installed. Further, a plurality of notches 55, preferably rectangular for example, are preferably created at substantially equal intervals from each other along substantially an entire periphery of the lowest part of the side member 53 so as to communicate with the sound path of the middle/high frequency sound range speaker 11 and the bass reflex port 80 of the low frequency sound range speaker 70.

Similar to the multi-speaker apparatus shown in FIGS. 1 and 2, the vibrator 12 of the middle/low frequency sound range speaker 11 vibrates and emits sound and the low frequency sound range speaker unit 84 of the low frequency sound range speaker 70 is driven and emits sound when electrical signals are input to the input terminal in the multi-speaker apparatus 10 shown in FIGS. 4 and 5.

Sound waves emitted from the curved outer surface of the vibrator 12 of the middle/high frequency sound range speaker 11 are transmitted in all directions away from the apparatus support surface. Sound waves emitted from the curved inner surface of the vibrator 12 via the cavity 28 and the sound path are emitted from the notches 55 which communicate with the sound path in all directions toward the apparatus mounting surface. Thus, the speaker 11 emits sound waves in all directions toward and away from the apparatus support surface so as to transmit sound waves toward and away from the apparatus support surface non-directionally.

Furthermore, sound waves emitted from the opening 78 in the cabinet 72 of the low frequency sound range speaker 70 in FIGS. 4 and 5 are emitted from the space between the bottom surface 74 of the cabinet 72 and the surface on which the apparatus 10 is installed or mounted in all directions toward the apparatus mounting or installation surface. Further, sound waves emitted from the bass reflex port 80 are transmitted in all directions away from the apparatus mounting or installation surface. Thus, the speaker 70 emits sound waves in all directions toward and away from the apparatus support surface so as to transmit sound waves toward and away from the apparatus support surface non-directionally.

Because the center axes of the middle/high frequency sound range speaker 11 and the low frequency sound range speaker 70, which have different frequency ranges from each other, are substantially aligned relative to an axis which extends substantially perpendicular to the apparatus mounting or installation surface, sound waves generated from the middle/high frequency sound range speaker 11 and the low frequency sound range speaker 70 are emitted in all directions both toward and away from the apparatus mounting surface.

Therefore, the sound generated and emitted by the apparatus 10 of FIGS. 4 and 5 is non-directional relative to the apparatus mounting surface. Accordingly, a range where the best stereo sound is produced is greatly increased as compared with the prior art and is exceptionally wide regardless of the distance between two of the multi-speaker apparatuses 10 which may be arranged to define right and left multi-speaker apparatuses.

Further, as compared to the multi-speaker apparatus shown in FIGS. 1 and 2, because the middle/high frequency sound range speaker 11 and the low frequency sound range speaker 70 are constructed in a single unitary integral in the multi-speaker apparatus shown in FIGS. 4 and 5, it is not necessary to adjust the center axes of the middle/high frequency sound range speaker 11 and the low frequency sound range speaker 70 relative to each other, the strength of the whole apparatus increases, it is easier to carry around the whole apparatus and it is less costly because the leg members 66 are not necessary, i.e., a number of parts is reduced.

It is noted that although a middle/high frequency sound range speaker 11 and a low frequency sound range speaker 70 are provided in each multi-speaker apparatus 10 described above, it is possible to use a plurality of different kinds of speakers having different frequency sound ranges. For example, it is possible to provide a woofer, a mid-range frequency speaker and a tweeter in a multi-speaker apparatus 10 described above. In such a case, the woofer, mid-range frequency and tweeter speakers are preferably disposed within one cabinet so that the center axes thereof are substantially aligned with each other and relative to an axis which extends in a direction that is substantially perpendicular to a surface upon which the multi-speaker apparatus is mounted or installed. In addition, notches or the like are created on the cabinet so that sound waves generated from the woofer, mid-range frequency and tweeter speakers are emitted in all directions toward and away from the apparatus mounting or installation surface.

Further, although the vibrator in which the electrodes are disposed on the curved inner and outer surfaces of the vibrating body made of a piezoelectric material is used in the middle/high frequency sound range speaker 11 in each multi-speaker apparatus 10 described above, it is possible to use a vibrator in which a piezoelectric element is bonded to part of a semi-spherical vibrating body made of metal, ceramic or synthetic resin as a driving device for vibrating the vibrating body. It is also possible drive the vibrating body electromagnetically by using a voice coil.

Although the horn and the cabinet are described above as being preferably formed of synthetic resin in each multi-speaker apparatus 10, the horn and the cabinet may be formed of metal, wood, ceramic, glass or the like.

Further, although the central sound path is described above as being formed of the first, second and third cylinders in the middle/high frequency sound range speaker 11 in each multi-speaker apparatus 10, the central sound path may be formed of one, two or four or more cylinders.

The cylinders composing the sound path of the horn 18 may have shapes other than the circular cylinder shape described above and may include an elliptic cylinder or a square cylinder shape.

Further, it is possible to use a cylinder having a passage which expands gradually from one end to the other end as the cylinder composing the sound path.

Although three substantially V-shaped notches are described above as being created in one cylinder in the middle/high frequency sound range speaker 11 in each multi-speaker apparatus 10 described above, it is possible to create four or more substantially V-shaped notches in one cylinder according.

It is also possible to create notches having a shape other than the substantially V-shape as the fold back portion or the opening of the sound path.

As described above, preferred embodiments of the present invention allows the multi-speaker apparatus to emit sound waves in all directions, i.e. non-directionally, both toward and away from a surface upon which the apparatus is mounted or installed. Accordingly, a range where the optimum stereo sound is produced is greatly increased and exceptionally wide regardless of distance between two of the two multi-speaker apparatuses arranged to be right and left multi-speaker apparatuses.

While the invention has been particularly shown and described with reference to preferred embodiments thereof, it will be understood by those skilled in the art that the foregoing and other changes in form and details may be made thereto without departing from the spirit and scope of the invention.

What is claimed is:

1. A multi-speaker apparatus, comprising:

a plurality of speakers having different sound frequency ranges and connected to each other, the plurality of speakers being arranged such that center axes of said plurality of speakers are aligned with an axis which extends in a direction which is substantially perpendicular to a surface upon which the apparatus is supported such that sound waves generated by each of said plurality of speakers are transmitted in all directions toward and away from the surface upon which the apparatus is supported wherein at least one of said plurality of speakers includes a first member facing the surface to transmit sound waves toward said surface and a second member facing away from the surface to transmit sound waves away from said surface; and at least one of said plurality of speakers includes a substantially semi-spherical vibrating body.

2. The multi-speaker apparatus according to claim 1, wherein one of said speakers comprises a low frequency range speaker and another of said plurality of speakers comprises a mid/high frequency range speaker.

3. The multi-speaker apparatus according to claim 2, wherein said low frequency range speaker includes a cabinet and a low frequency sound range speaker unit including a vibrating body and provided within said cabinet, said cabinet including a bottom plate arranged to be substantially parallel to and spaced from said surface upon which the apparatus is supported, an upper plate arranged to be substantially parallel to said bottom plate and a bass reflex port located at said upper plate, the low frequency sound range speaker unit being mounted to surround an opening formed in said cabinet so that said vibrating body of said low frequency sound range speaker unit faces said surface upon which said plurality of speakers are mounted.

4. The multi-speaker apparatus according to claim 2, wherein said middle/high frequency range speaker is mounted on said low frequency range speaker.

5. The multi-speaker apparatus according to claim 1, wherein said plurality of speakers include a middle/high frequency sound range speaker and a low frequency sound range speaker, the middle/high frequency sound range speaker including the substantially semi-spherical vibrating body, a driver for vibrating the vibrating body, a horn which extends from a curved inner surface of said vibrating body to an outside thereof and which has a sound path which expands from a center thereof to the outside and is folded back, a cavity which communicates with said sound path between said vibrating body and said horn; and an opening of said sound path is created for said horn and extends across almost an entire circumference in a direction substantially parallel to the surface upon which the apparatus is supported.

6. A multi-speaker apparatus, comprising:

at least two speakers being connected to each other and having different frequency sound ranges, each of the at least two speakers having a first member arranged to face away from a surface upon which the apparatus is supported and to emit sound waves in all directions away from the surface upon which the apparatus is supported and a second member arranged to face the surface upon which the apparatus is supported and to emit sound waves in all directions toward the surface upon which the apparatus is supported; and at least one of said at least two speakers including a substantially semi-spherical vibrating body.

7. The multi-speaker apparatus according to claim 6, wherein a first of the at least two speakers comprises a low frequency sound range speaker and a second of the at least two speakers comprises a mid/high frequency sound range speaker.

8. The multi-speaker apparatus according to claim 6, wherein said first member of a first of said at least two speakers comprises a vibrating body, an upper plate arranged above said vibrating body and a bass reflex port located at said upper plate arranged to emit sound waves in all directions away from the surface upon which the apparatus is supported.

9. The multi-speaker apparatus according to claim 6, wherein said second member of a first of said at least two speakers comprises a cabinet, a low frequency sound range speaker unit including a vibrating body and being mounted to surround an opening formed in said cabinet so that said vibrating body of said low frequency sound range speaker unit faces said surface upon which said apparatus is mounted.

10. The multi-speaker apparatus according to claim 9, further comprising a plurality of support members which are connected to said cabinet and support said apparatus such that the opening formed in said cabinet is spaced from the surface upon which the speaker is mounted.

11. The multi-speaker apparatus according to claim 6, wherein said first member of a second of said at least two speakers comprises said substantially semi-spherical vibrating body and a driver for vibrating the vibrating body, the substantially semi-spherical vibrating body being arranged to emit sound waves in all directions away from the surface upon which the apparatus is supported.

12. The multi-speaker apparatus according to claim 6, wherein said second member of a second of said at least two speakers comprises said substantially semi-spherical vibrating body, a driver for vibrating the vibrating body, a horn which extends from a curved inner surface of said vibrating body to an outside thereof and which has a sound path which expands from a center thereof to the outside and is folded back, a cavity which communicates with said sound path between said vibrating body and said horn; and an opening of said sound path is created for said horn and extends across almost the entire circumference and is arranged to emit sound waves in all directions toward a surface upon which the apparatus is supported.

13. The multi-speaker apparatus according to claim 6, wherein one of said at least two speakers comprises a middle/high frequency range speaker and the other of said at least two speakers comprises a low frequency range speaker, wherein said middle/high frequency range speaker is mounted on said low frequency range speaker.

14. The multi-speaker apparatus according to claim 6, further comprising a single cabinet, wherein said at least two speakers are provided in and mounted on said single cabinet so as to form a single unitary body construction.

15. The multi-speaker apparatus according to claim 14, further comprising a plurality of support members attached to said single cabinet and arranged to support said apparatus and cabinet spaced from the surface upon which the apparatus is supported.

16. The multi-speaker apparatus according to claim 6, wherein at least one of the at least two speakers includes a phase shifting device for bringing the sound waves which are transmitted in all directions away from the surface upon which the apparatus is supported substantially in phase with the sound waves which are transmitted in all directions toward the surface upon which the apparatus is supported.

17. The multi-speaker apparatus according to claim 6, wherein the at least two speakers are arranged such that center axes of said at least two speakers are aligned with an axis which extends in a direction which is substantially perpendicular to the surface upon which the apparatus is supported.

18. The multi-speaker apparatus according to claim 6, wherein the at least two speakers are arranged such that center axes thereof are aligned with each other.

19. The multi-speaker apparatus according to claim 6, wherein the at least two speakers comprise a woofer and a mid-range frequency speaker.

20. The multi-speaker apparatus according to claim 19, further comprising a tweeter.

* * * * *